United States Patent [19]

Landers

[11] 4,171,923

[45] Oct. 23, 1979

[54] OFFSHORE STRUCTURE GRAVITY GROUTING METHOD

[75] Inventor: Don B. Landers, Arlington, Tex.

[73] Assignee: Oil States Rubber Company, Arlington, Tex.

[21] Appl. No.: 904,197

[22] Filed: May 9, 1978

[51] Int. Cl.[2] ..... E02D 25/00

[52] U.S. Cl. ..... 405/225

[58] Field of Search ..... 61/100, 94, 86, 89, 61/95, 99; 405/225, 226, 227; 166/253

[56] References Cited

U.S. PATENT DOCUMENTS 3,878,687 4/1975 Tragesser, Jr. ..... 61/100 X 4,077,224 3/1978 Coone ..... 61/100 X

*Primary Examiner*—Dennis L. Taylor

*Attorney, Agent, or Firm*—Warren H. Kintzinger

[57] ABSTRACT

A method for gravity grouting the annulus between a piling and a piling sleeve wherein air pressure is used to expel water and foreign matter from the annulus. Air pressure is then reduced in the annulus that is sealed at the top and has a seal at the bottom capable of holding a differential pressure between water pressure at depth and atmospheric air pressure within the annulus. Grouting material is then fed to the annulus between the piling and the sleeve and permitted to set.

9 Claims, 4 Drawing Figures

OFFSHORE STRUCTURE GRAVITY GROUTING METHOD

Figure 1:
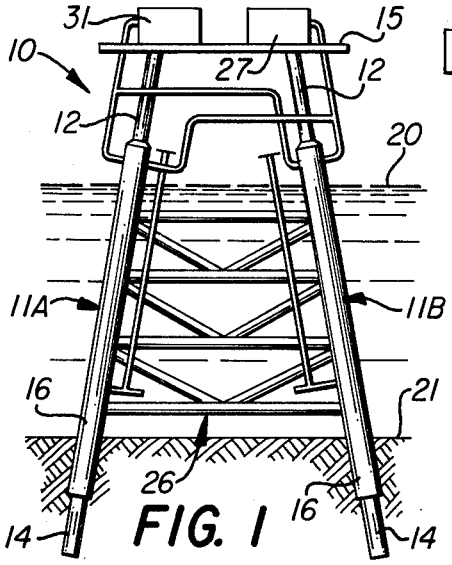

This invention relates in general to offshore marine platform structures employing multiple legs of piling and piling sleeve annulus defining structure containing grout, and more particularly, to gravity grouting of platform leg annulus for strengthening platform legs and stabilizing the platform mounting in the seabed.

Various procedures have been employed for grouting piling and piling sleeve annulus in offshore marine platform structures with, for example, one procedure known as pressure grouting. In pressure grouting, compressed air is introduced in the annular space between piling and piling sleeve, that is sealed at the top, to expel any sea water therein out via the lower end of the sleeve until air starts bubbling out or the air pressure equals the hydrostatic pressure. This exerts an upward force on the leg that may create problems, however, as the air is expelled, grout is injected into the annulus. The balance between grout injection and expelling of air is a delicate balance since, for example if the rate of air being expelled exceeds the grout injection rate mud and water enter the annulus from the bottom, and if the grout injection rate exceeds the air exhaust grout channels out the annulus bottom. Perfection in proper balance control is difficult to achieve at an offshore platform erection site since lab type metering controls are generally not available and the operator is in a sense flying blind.

Grout is used for additional strength, bulk and mass in the structure, to eliminate metal to metal wear and fatigue, transfer loads into structure properly and to help prevent corrosion. With pilings and piling sleeves extending through the mud line at seabed a critical stress area is encountered, and with pressure grouting, the lower area could be very porous, honey-combed, and contain diluted-weakened grout due to mud and water having entered the annulus with, as a result, the jacket stress pattern not predictable with reasonable accuracy. If mud is present in the annulus as grout is injected, it becomes infused with the grout and if water is present it rises in the annulus as the grout gravitates therethrough displacing water. At one offshore location a grout operator purposely allowed a 5 to 10 psi backoff exhaust from the annulus before injecting grout with the equivalent of 10 to 20 feet of mud and water re-entering the annulus to, in accord with his reasoning, give a "cushion". With pressure grouting if air is expelled too fast grout can be blown out the exhaust valve. Further, a piling and piling sleeve jacket must extend into seabed soil before any grout can remain in the annulus since some type of support must be present or the grout being fed in pressure grouting with gravitate out. While pressure grouting imposes less in original equipment costs in that no packers or mechanical grout seals, no grout lines, and no packer inflation lines are needed the time required for pressure grouting is generally considerably greater.

Applicant uses a grouting approach with grouting to a closed annulus sealed at the top and having a seal at the bottom that may take the form of a back pressure seal. The back pressure seal allows mud and liquid to go downward by the seal with sufficient air pressurization of the annulus but when pressure is released the seal blocks return of mud and liquid back into the annulus. With the annulus at atmosphere pressure grout is injected into the annulus either from above the water surface or through grout lines to a bottom area of the annulus or a combination of both. With grout injection into a lower portion of the annulus a high density grout is attainable and if by any chance there is a little water remaining the grout forces the water to rise thereabove instead of leaking into the grout.

It is therefore a principal object of this invention to provide improved grouting to the annulus between a piling and a piling sleeve sealed at the top and having an annulus seal at the bottom.

Another object is to eliminate mud and or water dilution and contamination of grout applied to the annulus of an offshore platform leg or piling and piling sleeve.

A further object is to provide an offshore platform leg annulus grouting process with the feeding of grout to, relatively, a dry atmosphere at relatively low atmospheric pressure in a sealed annulus.

Still another object is to attain high density grout without water and mud induced porosity, honey-combing, and without dilution weakening of grout in a platform leg annulus.

Features of the invention useful in accomplishing the above objects include, in an offshore structure grouting method, grouting fed to the annulus between a piling and a piling sleeve that is sealed at the top and that has a sealing structure set in place at the bottom of the annulus. The bottom sealing structure is a back pressure seal that can either be a constant tension or inflatable type seal such as inflatable grout packers that would be inflated after water and mud in the annulus is evacuated but prior to release of annulus air pressure to atmosphere. Whatever form of lower back pressure seal employed the lower seal allows mud and liquid to go downward passing by the seal with sufficient air pressurization of the annulus, and then, when air pressure is released to atmospheric pressure the seal blocks return of mud and liquid back into the annulus. An alternate to purging the annulus of mud and water by the lower seal is to pressure the mud and water out of a flood valve located low in the annulus. With the annulus at atmospheric pressure grout is injected into relatively dry atmosphere with gravity grouting feeding to the upper portion of the leg cylinder annulus or grout feeding through grout lines to a lower section of the annulus or a combination of both grout feeds. The lower seal acts to hold the grout with a differential pressure thereacross with as related to water depth complete initial grout filling with more shallow depths and/or partial filling to hydrostatic pressure balance and setting of grout and later completion filling of grout.

Specific embodiments of offshore platform leg structures for processes presently regarded as the best modes of carrying out the invention are illustrated in the accompanying drawing.

Figure 2:
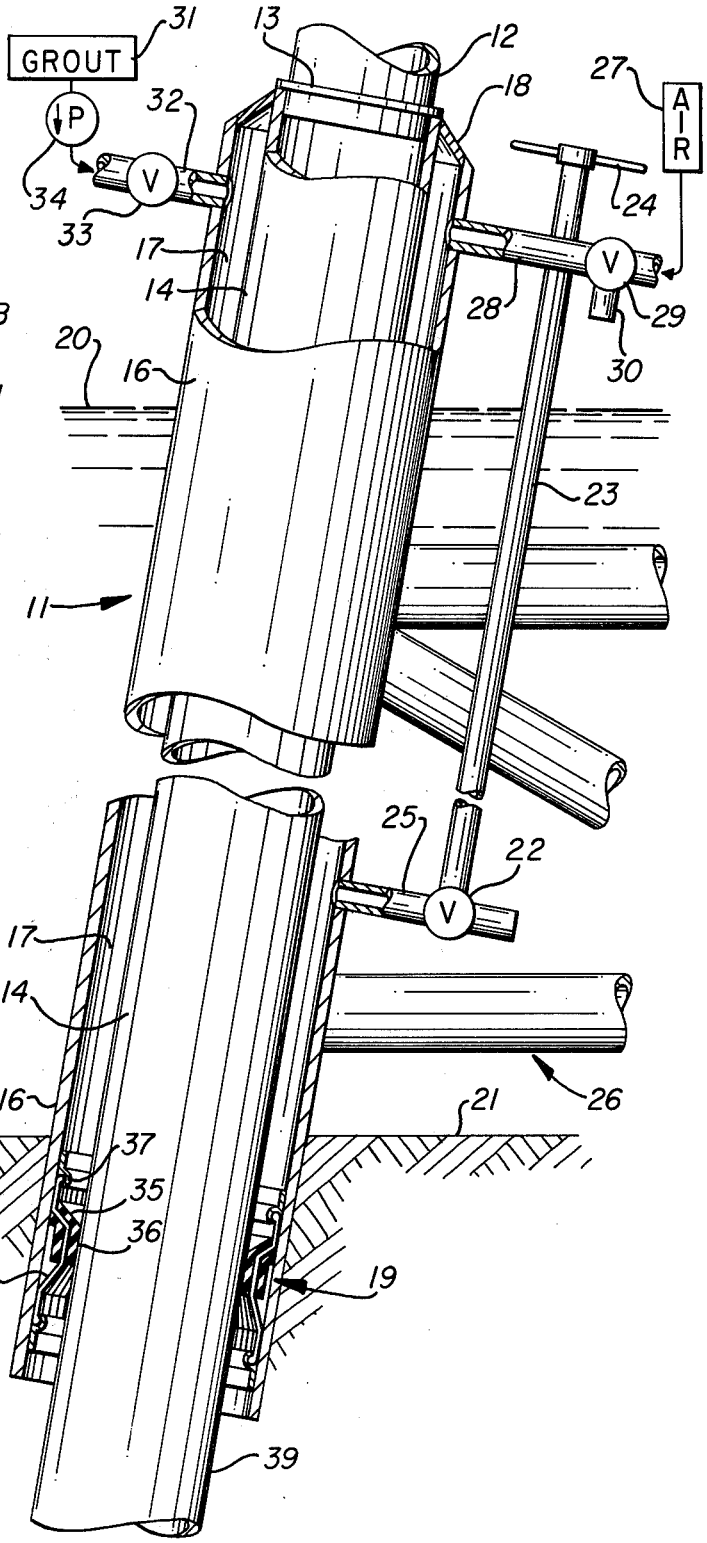
Figure 3:
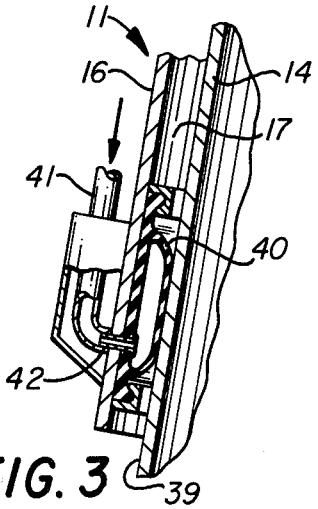
Figure 4:
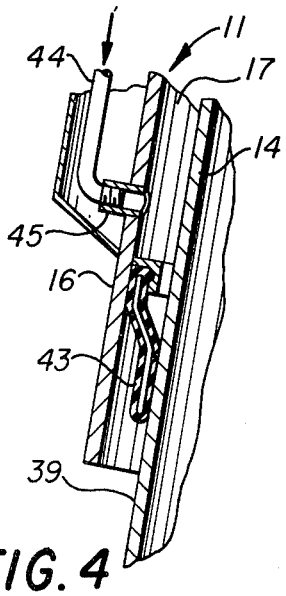

In the drawing:

FIG. 1 represents an elevation view of an offshore marine platform structure equipped for gravity grouting;

FIG. 2, a partial broken away and sectioned elevation view of a platform leg showing leg piling and sleeve annulus detail sealed at the top and with a back pressure constant tension seal set in place in the bottom and with flood valve, grout and air lines shown;

FIG. 3, a partial broken away and sectioned view of an inflatable packer seal used in place of the back pressure seal of FIG. 2; and, FIG. 4, a partial broken away and sectioned view of an alternate back pressure constant tension seal used in place of the lower seal of FIG. 2.

Referring to the drawing:

The offshore platform structure 10 of FIG. 1 is equipped with a number of downwardly extending legs such as legs 11A and 11B that have upward extensions 12 fastened as by welding to the top plates 13 of the legs 11A and 11B. Top plates 13 on the top of the inner cylindrical piling tubes 14, referring also to FIG. 2, of the legs 11A, 11B and back legs 11 support extensions 12 and the service platform 15 mounted thereabove. Each leg 11 also includes a piling sleeve 16 that forms an annulus 17 with the piling tube 14 of that leg 11 sealed at the top by truncated conical top plate 18 welded in place so as to completely seal the annulus 17. The top plates 18 that could be flat instead of truncated cones or even an annular extension of top plates 13 also serve to help hold the piling sleeves 17 in proper spaced relation to their respective piling tubes 14. A back pressure seal 19 in the form of an inverted grout seal of the constant tension type set in place at the bottom of piling sleeve 16 also aids in holding the piling sleeves 16 and respective piling tubes 14 in proper spaced relation. The legs 11 generally extend from above the water surface 20 to below the mud line 21 at the sea bed with it being recognized that some legs of some offshore platforms do not extend into the sea bed. Further, the inner cylindrical piling tubes 14, as a general rule, are longer than their piling sleeves 16 so as to be pile driven into the sea bed further than the piling sleeves 16.

Each leg 11 is equipped with a flood valve 22 in the lower region thereof that may be opened and closed by a reach rod 23 extended from a handle 24 at the top of the leg 11 to the flood valve 22 in a line 25 in fluid communication with the leg annulus 17 that may be opened to the sea through the flood valve 22. Flood valves 22 that are used for controlled flooding of legs 11 in tilting and positioning the mounting leg structure 26 of an offshore platform in the upright state for driving of the piles 14 are used in some instances for the air pressure blow removal of mud and water from a leg annulus 17. High pressure air from air pressure source 27 is fed through line 28 as controlled by valve 29 in air pressurizing leg annulus 17. Valve 29 is a three position valve whereby it may be shut off, positioned to pass high pressure air to annulus 17, or positioned to exhaust air from annulus 17 through outlet line 30.

Grout is supplied in the leg annulus 17 grouting process from grout supply source 31 through grout line 32 as controlled by grout line valve 33 and/or grout line pump 34 to feed grout to the top of annulus 17 in gravity grouting of the leg. With the structure of FIGS. 1 and 2, the process for gravity grouting upright offshore platform legs 11 involves the use of a seal 19 with annular rubber seal body 35 having an annular skirt extension 36 from an annular mounting bead 37 fixed in place within sleeve 16 with the skirt extension resiliently biased inwardly by a plurality of closely spaced seal structure spring finger members 38 toward sealing engagement with the outer cylindrical surface 39 of piling tube 14. Pressurized air is fed to the annulus 17 to such a degree as to force mud and liquid downward passing by the pressure deflected seal 19 which, when annulus pressure is released to atmosphere, blocks return of mud and sea water back into the annulus 17. With the annulus then returned to atmospheric presure grout is injected through line 32 into the annulus 17. An alternate to pressure purging the annulus 17 of mud and water that passes by the lower seal 19 is to pressure purge the mud and water out through flood valve 22 that is opened through use of reach rod 23 and then closed after the purging and before opening of the annulus to atmospheric pressure.

An inflatable packer seal 40 of a conventional nature is shown in FIG. 3 that can be used in place of the lower seal 19 of FIG. 2. Air pressure through line 41 and a fitting structure 42 to the inflatable packer seal 40 is controlled to let mud and sea water pass by as purged by air pressure within annulus 17 and then a seal the annulus from re-entry of mud and sea water when annulus pressure is dropped to atmospheric pressure. If the alternate of purging mud and water through a flood valve 22 is employed as shown with FIG. 2 then the inflatable packer seal 40 is maintained in the inflated sealed state throughout the grouting process.

The constant tension seal 43 of FIG. 4 can also be used in place of the lower seal 19 of FIG. 2. Constant tension seal 43 gives substantially the same operation results in the process as attained with lower seal 19. A lower annulus grout line 44 and fitting 45 is also shown in FIG. 4 that would facilitate the feeding of grout to low in the annulus 17 when pressure therein has been reduced to a lower pressure level such as atmospheric pressure. This grout feed may be used in combination with the other annulus seal configurations and either as a grout feed by itself in place of a top annulus 17 gravity grout feed or in a combination of both grout feeds. In any event each of the lower seals shown acts to hold the grout fed to the annulus 17 with a differential pressure across the seal between water pressure at depth and atmospheric pressure within the annulus 17. With relatively shallow sea bed depth grouting of an annulus may be completed in one step or with installation in deeper water the grout fed to an annulus 17 may be accomplished in two stages, one—a partial filling to approximate hydrostatic pressure balance and setting of the first fed grout and second—followed by later completion feed of grout.

Whereas this invention has been described with respect to several process embodiments thereof, it should be realized that various changes may be made without departing from the essential contributions to the art made by the teachings hereof.

I claim:

1. A method of grouting annulus of legs and piling and piling sleeves of offshore structures with pilings or legs extending downwardly from the area of the waterline to depth in water and generally into the seabed: said method comprising the steps of a. setting a seal in place at the lower end of said annulus to close the annulus at the lower end;

b. sealing the upper end of said annulus to thereby close the annulus at the upper end;

c. introducing compressed air into said annular spaced to a compressive level sufficient to expel water from the lower portion of said annulus;

d. opening passage means for the passage of water from the lower portion of said annulus;

e. reducing the air pressure in said annulus after water has been expelled from said annulus;

f. feeding fluid grout into said annulus after water has been expelled from said annulus;

g. letting grout fed into said annulus set in place; and wherein opening passage means for the passage of water from the lower portion of said annulus is using a deflectable back pressure seal capable of maintaining a differential pressure between hydrostatic pressure at water depth of the seal and reduced pressure within the annulus; and building up air pressure within the annulus enough above hydrostatic pressure at seal depth to deflect the seal as said opening passage means step for the passage of water from the lower portion of said annulus.

2. The method of grouting annulus of legs and piling sleeves of offshore structures as defined by claim 1 wherein the feeding of fluid grout into said annulus is initiated after the step of reducing air pressure in said annulus.

3. The method of grouting annulus of legs and piling sleeves of offshore structures as defined by claim 2, wherein the step of reducing air pressure in said annulus reduces air pressure in said annulus to substantially atmospheric pressure.

4. The method of grouting annulus of legs and piling sleeves of offshore structures as defined by claim 1, wherein the step of reducing air pressure in said annulus reduces air pressure in said annulus to substantially atmospheric pressure.

5. A method of grouting annulus of legs and piling and piling sleeves of offshore structures with pilings or legs extending outwardly from the area of the waterline to depth in water and generally into the seabed: said method comprising the steps of a. setting a seal in place at the lower end of said annulus to close the annulus at the lower end;
b. sealing the upper end of said annulus to thereby close the annulus at the upper end;
c. introducing compressed air into said annular space to a compressive lever sufficient to expel water from the lower portion of said annulus;
d. opening passage means for the passage of water from the lower portion of said annulus;
e. reducing the air pressure in said annulus after water has been expelled from said annulus;
f. feeding fluid grout into said annulus after water has been expelled from said annulus;
g. letting grout fed into said annulus set in place; and, wherein opening passage means for passage of water from the lower portion of said annulus is using an inflatable type seal capable of maintaining a differential pressure between hydrostatic pressure at water depth of the seal and reduced pressure within the annulus when inflated; building up air pressure within the annulus enough above hydrostatic pressure at seal depth to pass water by the seal with the seal then deflated as said opening passage means step for the passage of water from the lower portion of said annulus; said inflatable type seal is a packer seal with inflation and deflation control accomplished by valve control of air pressure and exhaust from above the sea water surface; and wherein said packer seal is reinflated after water is pressure purged thereby and before the step of reducing air pressure.

6. A method of grouting annulus of legs and piling and piling sleeves of offshore structures with pilings or legs extending downwardly from the area of the waterline to depth in water and generally into the seabed: said method comprising the steps of a. setting a seal in place at the lower end of said annulus to close the annulus at the lower end;
b. sealing the upper end of said annulus to thereby close the annulus at the upper end;
c. introducing compressed air into said annular space to a compressive level sufficient to expel water from the lower portion of said annulus;
d. opening passage means for the passage of water from the lower portion of said annulus;
e. reducing the air pressure in said annulus after water has been expelled from said annulus;
f. feeding fluid grout into said annulus after water has been expelled from said annulus;
g. letting grout fed into said annulus set in place; and, wherein the opening passage means for the passage of water from the lower portion of said annulus is the opening of a flood valve during the pressure purging of water from said annulus; and then closing said flood valve before the step of reducing pressure in said annulus.

7. The method of grouting annulus of legs and piling sleeves of offshore structures as defined by claim 1, wherein the feeding of grout into said annulus is a gravity feeding of grout to high in the annulus.

8. The method of grouting annulus of legs and piling sleeves of offshore structures as defined by claim 1, wherein the feeding of grout into said annulus is pumped feeding of grout to low in the annulus.

9. A method of grouting annulus of legs and piling and piling sleeves of offshore structures with pilings or legs extending downwardly from the area of the waterline to depth in water and generally into the seabed: said method comprising the steps of a. setting a seal in place at the lower end of said annulus to close the annulus at the lower end;
b. sealing the upper end of said annulus to thereby close the annulus at the upper end;
c. introducing compressed air into said annular space to a compressive level sufficient to expel water from the lower portion of said annulus;
d. opening passage means for the passage of water from the lower portion of said annulus;
e. reducing the air pressure in said annulus after water has been expelled from said annulus;
f. feeding fluid grout into said annulus after water has been expelled from said annulus;
g. letting grout fed into said annulus set in place; and, wherein the feeding of grout into said annulus is a combination of gravity feeding grout to high in the annulus and pumped feeding of grout to low in the annulus.

* * * * *